United States Patent [19]

McKee

[11] 4,113,179

[45] Sep. 12, 1978

[54] CONNECTOR CONSTRUCTIONS AND ATTACHING MEANS THEREFOR

[75] Inventor: William H. McKee, West Covina, Calif.

[73] Assignee: TRW Inc., Elk Grove Village, Ill.

[21] Appl. No.: 736,942

[22] Filed: Oct. 29, 1976

[51] Int. Cl.[2] ..... H01R 13/54

[52] U.S. Cl. ..... 339/91 R; 339/75 M; 339/126 R; 339/176 M

[58] Field of Search ..... 339/75 M, 91 R, 103, 339/105, 107, 128, 132, 139, 176 M, 176 MP

[56] References Cited

U.S. PATENT DOCUMENTS

| | | | |
|---|---|---|---|
| 3,365,694 | 1/1960 | Parker | 339/91 R X |
| 3,409,859 | 11/1968 | Krehbiel | 339/91 R |
| 3,544,951 | 12/1970 | Roberts | 339/91 R |
| 3,566,336 | 2/1971 | Johnson et al. | 339/103 M |
| 3,753,212 | 8/1973 | Yamada et al. | 339/91 R |
| 3,801,953 | 4/1974 | Lynch | 339/176 MP |
| 3,879,099 | 4/1975 | Shaffer | 339/107 X |

*Primary Examiner*—Roy Lake
*Assistant Examiner*—E. F. Desmond
*Attorney, Agent, or Firm*—Neuman, Williams, Anderson and Olson

[57] ABSTRACT

Ribbon-type electrical connectors of substantially all plastic insulator construction are disclosed which provide for automatic reliable latching of mated connectors as the two connectors are pressed together. In one embodiment the latching elements may be integrally molded J-shaped latch portions. In other embodiments separate metal latch components are inserted in the connectors and self-lock in position.

37 Claims, 24 Drawing Figures

FIG. 1
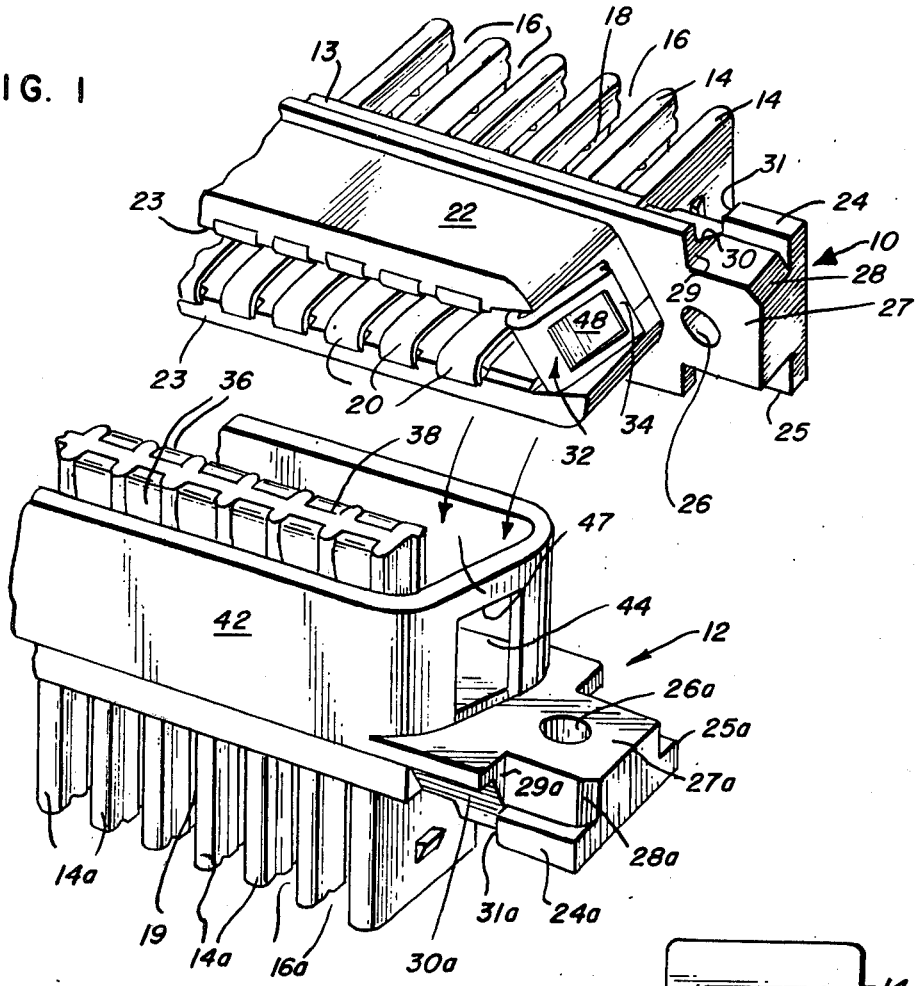
FIG. 3
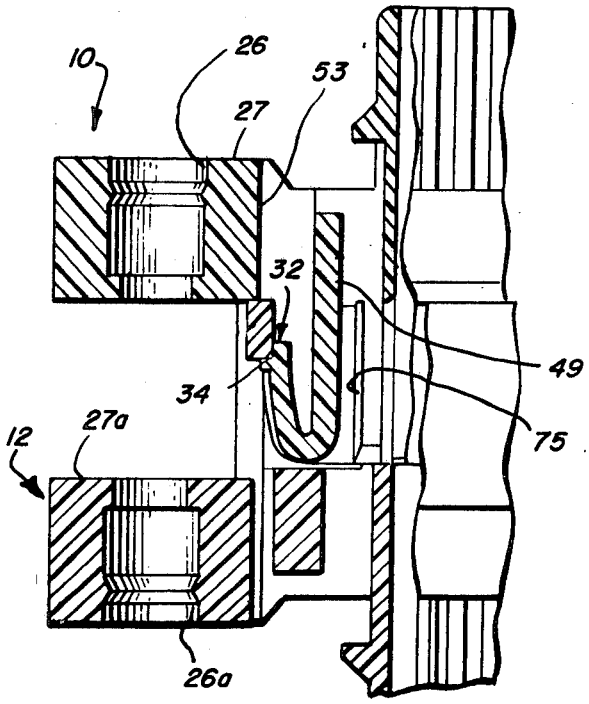
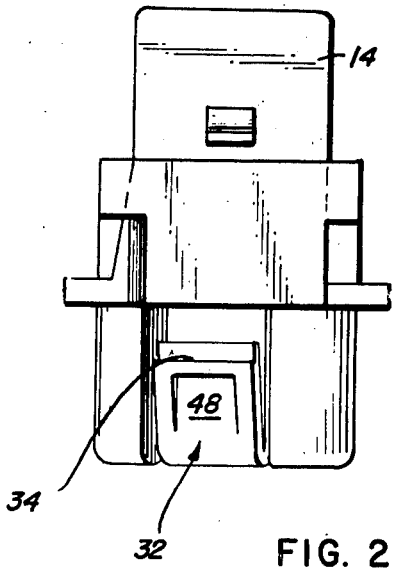
FIG. 2

FIG. 15
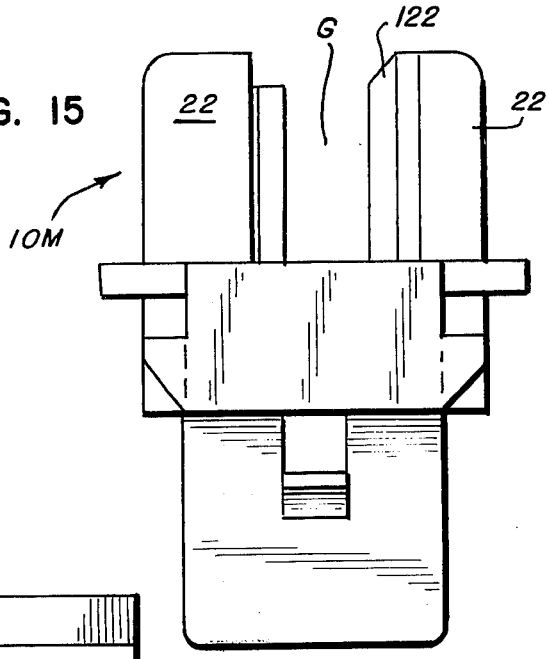
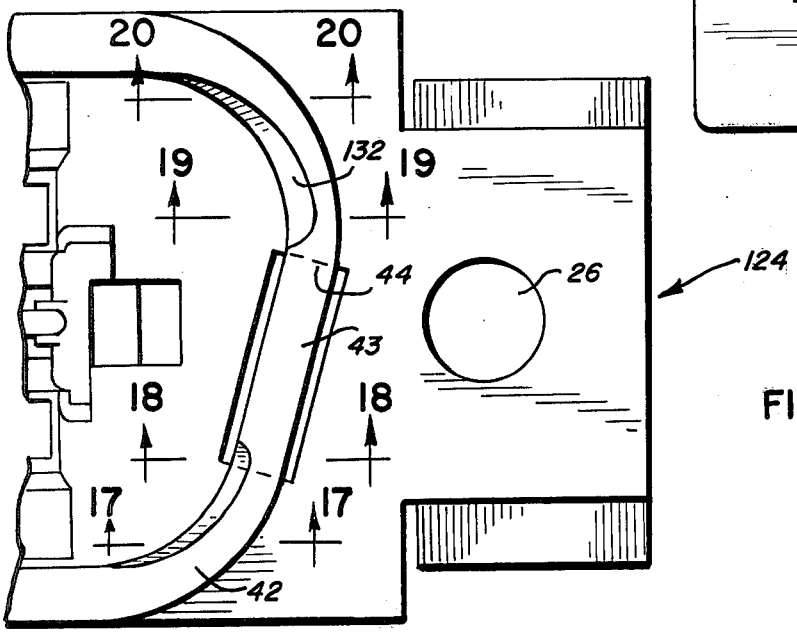
FIG. 16
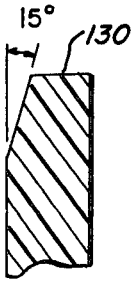
FIG. 17
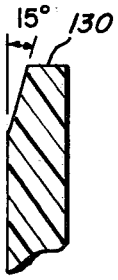
FIG. 18
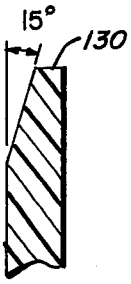
FIG. 19
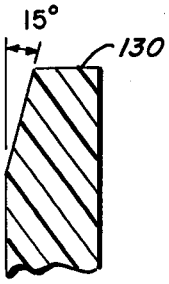
FIG. 20

FIG. 21
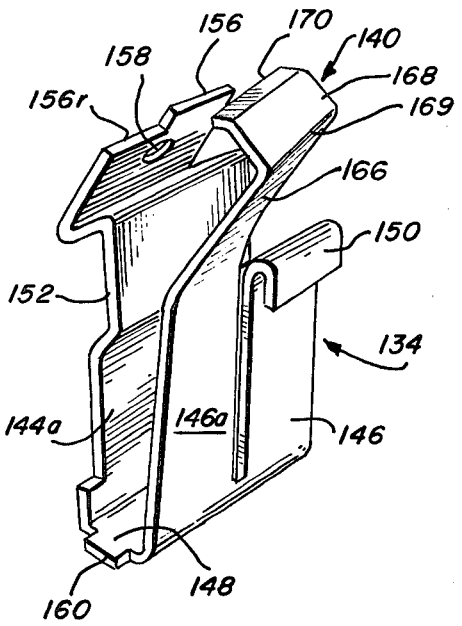
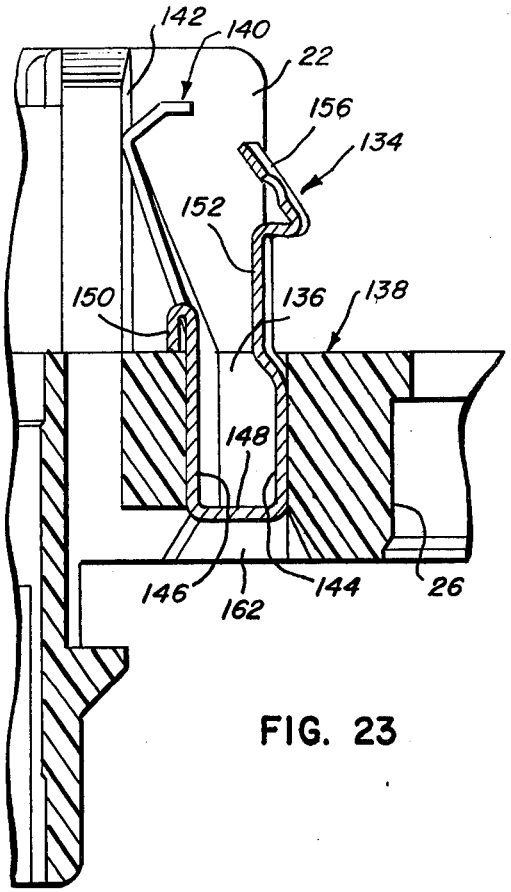
FIG. 23
FIG. 22
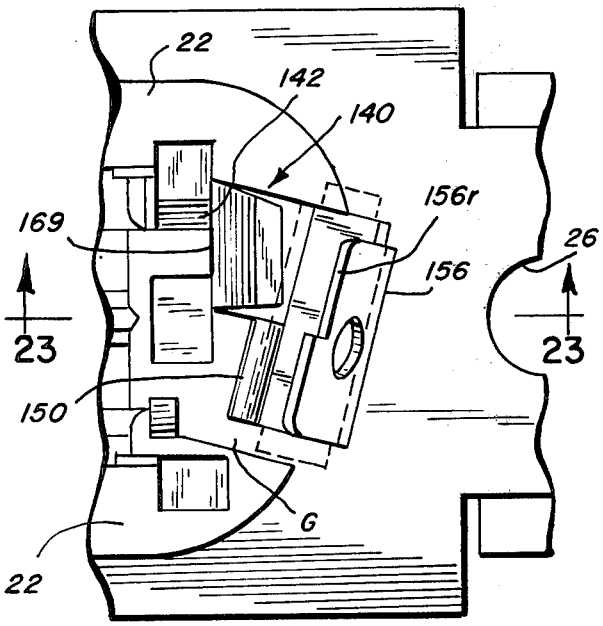
FIG. 24
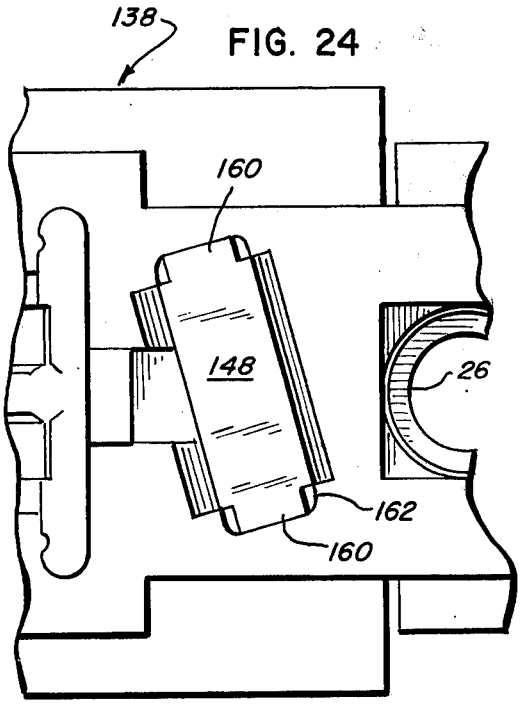

CONNECTOR CONSTRUCTIONS AND ATTACHING MEANS THEREFOR

My copending application Ser. No. 736,895, filed Oct. 29, 1976, pertains to mounting means and hoods for connectors of the type described herein.

This invention relates to connecting means which may be employed for effecting an interlock between connectors. More specifically, this invention relates to connecting means for use with ribbon-type connectors, the hereinafter disclosed connecting means being employed for effecting connector-to-connector interlocks.

Included in such connector constructions are those presently manufactured by TRW Inc. of Elk Grove Village, Illinois and referred to as Cinch Ribbon connectors. Such connector constructions may be employed in the termination of wires by either soldering or solderless techniques, an example of the latter being that disclosed in McKee and Witte application Ser. No. 443,678, filed Feb. 9, 1974.

Ribbon connectors of the type referred to herein normally employ a body of electrically insulating plastic which has formed therein a plurality of wire receiving channels in which wires are received and engaged by metal terminating contact members. The metal contacts extend through the thickness of the plastic body, and have exposed mating portions adapted to engage with mating portions of another connector whereby an electrical connection is established between female and male connectors, or connectors more commonly known as receptacle and plug types, respectively.

The art has previously employed separate securing means, such as screws or the like, for purposes of maintaining interlocked connector members in an assembled relationship. In addition to requiring the securing devices as part of the product cost, such connectors impose a significant additional cost to the user for the time and effort necessary to apply such securing means.

Steinbach U.S. application Ser. No. 672,643, filed Feb. 1, 1976, discloses a connector receptacle construction which avoids the need for separately applied fasteners. In the Steinbach devices the receptacle connector has opposed resilient latch means with projecting prongs which are adapted to mate with receiving openings in the skirt portion of a mating plug connector. However, it has been found that such connector constructions if formed of certain insulating materials are rather weak in holding force, and somewhat difficult to disengage at opposed ends, particularly when formed of polyester plastics which are in wide usage in such connectors. Thus, upon the exertion of a connector parting force, the interlocking latch means may fracture at low loads leading to interlock failure. Also, it was found that the specific latch constructions employed required the utilization of intricate and expensive molding techniques, specifically, a side acting mold was required to form latching detent shoulders.

It is an object of the provided invention, therefore, to provide improvements in the means for joining ribbon-type electrical connectors.

It is an object of this invention to provide improved connector designs of the subject type which will provide automatic, convenient, reliable and secure joining of the connectors to one another as they are interconnected with one another, and which also are adapted for joining to prior connectors requiring separate fasteners.

It is an object of this invention to provide a latch construction formed of electrically insulated plastic integrally molded with the connector body at the time of connector formation, the latch construction being such that simple draw molds are permitted and no side coring is necessary.

Another object of this invention is to provide a connector construction in which a resilient latch is integrally formed with the connector body and affords a desired displacement of an interlocking detent formed on a terminal portion thereof, while enabling stress imparted to the main flexing latch body to remain sufficiently below the elastic limit of the plastic from which formed to avoid fracture thereof.

It is another object of this invention to provide connectors with flexible latch constructions which are readily engageable by a prod or similar tool for resiliently urging the locking detent portions of such latches from interlocking engagement with a connector latch-receiving opening or window.

It is yet another object of this invention to provide a connector latch construction which may be readily inserted in connector body openings, such latch elements having portions assuring desired fixed retention within such openings without movement in the course of connector use.

It is another object of this invention to provide construction which assure ready "rollout" disengagement between two interlocking connector plug and receptacle members. (The term "rollout" as used herein refers to connector ability to unmate or disengage from a connector with which interlocked by unlatching one latch and by lifting the unlatch end of one connector in a rotary movement, effect unlatching of opposed connector ends.)

It is another object of this invention to provide connector constructions designed to assure proper contact alignment prior to effecting an interlock and assuring ready "rollout" during connector disengagement whereby contact and connector damage is obviated.

It is a still further object of this invention to provide a connector latch construction designed to assure desired alignment of connector receptacles and plugs prior to interlock and also assist disengagement therebetween as will hereinafter be explained in detail.

The above and other objects of this invention will become more apparent from the following detailed description and appended claims when read in the light of the accompanying drawings.

In one embodiment of the provided invention a connector receptacle body is provided having a plurality of wire-receiving channels disposed on one side of the central connector portion. A skirt-like body portion defining spaced parallel walls extends from the opposite side of said central portion and has latch means of generally J-shaped configuration formed between the opposed ends of said parallel walls. Each terminal J-portion of each latch extends outwardly and has a projecting lip adapted to engage an opening formed in a skirt portion of a connector plug in interlocking engagement when the connector receptacle and plug are interconnected. Access formed in a latch face portion enables a prod to inwardly move the J-shaped latch and disengage each latch lip from locking engagement with a mating recess with which effecting an interlock.

In other latch constructions, discrete metallic clip-like latches may be inserted in openings formed in connector receptacles by virtue of a through-core method of molding. The metallic latches have formed integrally therewith terminal detent portions as well as portions adapted to fixedly mount the clip member in position in immovable relationship with the connector body in which disclosed.

In various metal latch constructions, adapted to be inserted in openings predeterminately formed in the connector body, reverse bend stop portions adapted to prevent removal of such latches from the connectors in which mounted in the normal course of disengaging interlocked connector members are employed.

In various connector receptacle embodiments body portions adjacent metal latches mounted therein are predeterminately formed to guide a mating connector plug into desired engagement therewith and to provide desired latch movement during connector locking and disengagement steps. A modified plug connector skirt is also provided to facilitate rollout during connector disengagement.

DESCRIPTION OF THE DRAWINGS

FIG. 1 is a fragmentary perspective view illustrating a receptacle version of a connector having a J-shaped latch means integrally formed therewith in the process of being moved into interlocking engagement with a plug version of the connector;

FIG. 2 is an end elevational view of the connector receptacle of FIG. 1;

FIG. 3 is a sectional view illustrating an interlock between the J-shaped latch of a receptacle after the same has interlocked with the plug of FIG. 1;

FIG. 15 is an end elevational view of the connector receptacle of FIG. 13;

FIG. 16 is a fragmentary plan view of the connector plug of FIG. 12;

FIG. 17 is a sectional view taken on line 17—17 of FIG. 16;

FIG. 18 is a sectional view taken on line 18—18 of FIG. 16;

FIG. 19 is a sectional view taken on line 19—19 of FIG. 16;

FIG. 20 is a sectional view taken on line 20—20 of FIG. 16;

FIG. 21 is a perspective view of a modified clip construction which may be employed in a connector receptacle;

FIG. 22 is a fragmentary top plan view of the latch of FIG. 21 disposed in a position of use in a connector receptacle;

FIG. 23 is a sectional view taken on line 23—23 of FIG. 22; and

FIG. 24 is a fragmentary bottom plan view of the latch connector assembly of FIG. 22.

In FIG. 1 a female or receptacle connector 10 is illustrated prior to being urged into interlocking engagement with a male or plug connector 12. Connector 10 comprises a central body portion 13 from which extend a plurality of integrally molded barrier portions 14, the barriers defining therebetween wire-receiving channels 16 in which are disposed metal, wire-gripping contacts 18. The wire-gripping portions of elements 18 disposed in the channels 16 are integral with contact mating portions 20 which extend through the central connector portion 13. Mating portions 20 are aligned in series along opposed inner wall portions 23 of the skirt-like body portions 22 of the connector 10 which resemble opposed, parallel, projecting walls.

Figure 4:
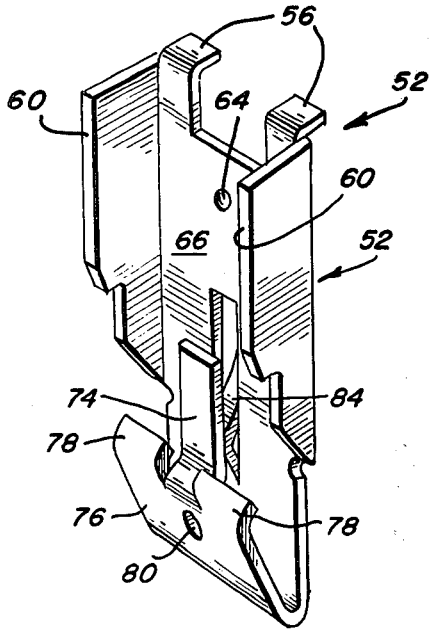
FIG. 4 is a perspective view of a clip-like metal latch which may be mounted in an opening predeterminately formed in a receptacle similar to that of FIG. 1.

Each longitudinal end portion of connector 10 is defined by laterally projecting ears or tabs 24 and 25 extending from a thicker central portion 27 through which an aperture 26 is disposed in which a securing means such as a screw or the like may be received. It will be noted that connector portion 27 has a beveled outer corner 28 on the same side as a sloping ramp portion 30. Ramp 30 defines at an end surface a stop shoulder 29 adjacent ear 24. The ears 24 and 25 define projecting stop surfaces 31, and beveled ramp surfaces are provided at 30, for cooperative engagement with mounting clips and with hoods as described in my co-pending application Ser. No. 736,895.

The end portions of the connector 12 are identical with those of connector 10 and bear the same numerals for corresponding parts and the suffix "*a*."

Defining opposed ends of the wall portions 22 of the connector 10 are resilient latch members 32 of substantially J-shaped configuration, see FIG. 3. Each latch has a laterally projecting lip 34 adapted to function as a locking detent.

The mating portions 20 of the contacts 18 shown in FIG. 1 are adapted to be received in slidable engagement with mating contact portions 36 disposed on opposed surface portions of a central projecting barrier or support rib 38 of plug connector 12. Thus electrical contacts are established between the wires terminated in the two connectors when intermated.

It will be noted from FIG. 1 that the contact mating portions 36 extend from contact portions 19 disposed within channels 16*a* of the connector 12 defined by barrier portions 14*a*. The contact mating portions 36 of the plug connector 12 together with the central insulating support 38 are centrally disposed of an encompassing skirt 42. The skirt 42 is integrally formed with the connector body and has latch-receiving openings 44 disposed in opposed end portions. The relative dimensions of the connectors 12 and 14 are such that when receptacle 10 and the plug 12 are interconnected into an assembly, wall portions 22 of connector 10 are snugly received within the inner periphery of skirt 42 of connector 12. Simultaneously, the resilient latches 32 at each end of the connector 10 (only one of which is seen in FIGS. 1 and 3), are biased inwardly as the projecting detents 34 thereof slidably engage inner wall portions of the skirt 42 of the plug 12. The engagement continues until the projecting detents 34 snap beneath lower opening-defining edge portions 47 of the skirt portion 42 of connector 12; edge 47 defines in part latch-receiving opening 44, see FIG. 3.

Each latch 32 is formed in a connector opening or aperture 53 permitting through-core molding of the connector and dispenses with the need for side coring in the course of connector formation. It is seen from FIG. 3 that longer leg 49 of the latch 32 integrally formed at its upper proximal end with the connector body permits adequate movement of the detent lip 34. Adjacent stop surfaces 75 of the connector body disposed to the rear of opposed longitudinal lateral edge portions of the longer leg 49 comprise stops limiting the inward flexing of the latch 32, thereby minimizing the danger of fracture at its juncture with the connector body.

The structure illustrated in FIGS. 1 and 2 is duplicated at the left end portions of such connectors. It will be noted that the disposition of the latches 32 are at angles so as to form a generally uniform, trapezoidal configuration with the wall portions 22 which interfit with the corresponding inner periphery of the slightly larger skirt 42 of the connector plug 12. The generally trapezoidal configurations of the connector portions assure proper polarization of the connectors when joined to insure proper engagement of the mating contact portions of such connectors.

A depression 48 in each resilient latch 32 facilitates engagement with a prod or pry element whereby purchase may be obtained so as to inwardly flex the projecting detent 34 of the terminal J portion of the latch during disengagement from the aperture-defining ledge 47 of the connector plug 12 and thereafter prying the connector apart. Separation of mated connectors 10 and 12 thus may be initiated conveniently by pressing inwardly on a latch with a prod and simultaneously pressing downwardly on the outer edge of connector tab 27*a*. The latter serves as a fulcrum whereby the prod becomes a lever for prying upwardly (as seen in FIG. 3) on the detent 34 relative to the connector 12, to begin the separation. Following one latch disengagement at one end of the connector assembly, the connector receptacle may be rolled or pivoted outwardly, the remaining latch disengaged thereby and the two connectors separated completely.

The integral latch construction illustrated in FIGS. 1 to 3 of the drawings may be employed in a variety of integral plastic connector constructions. Thus the number of wire-receiving channels may vary from 14 to as many as 64. Such connectors may be formed of 30% glass filled polyester resin and vary in length from $1\frac{3}{4}$ inches (14 channels) to $3\frac{7}{8}$ inches (64 channels) and are approximately 0.6 inch wide.

It has been found, however, that desired electrical grade insulating plastic from which connectors of the subject type often are formed lacks strength and resiliency. Thus, with connectors formed of such materials, the latch members 32 may fracture from the connector blades with which integrally formed under static loads. Also, oftentimes in the course of unlatching, after one latch is disengaged from the connector plug at one end and upon subsequent pivotal endwise "rollout" separation of the connectors, the unlatched J-shaped member 32 may be caught or jammed in the plug and be fractured.

The metal latch 52 of FIGS. 4 through 8 is designed for insertion in preformed connector aperture 54 (FIG. 6) of the receptacle connector 10*a*. A comparison of FIGS. 3 and 6 readily reveals the manner whereby the stronger and more resilient metallic clip 52 may be substituted for the integrally formed J-shaped latch member 32 in connector 10*a* of substantially the same configuration as connector receptacle 10.

Whereas the plastic J-shaped integral latch 32 fractures at about 10 pounds of parting force, utilization of the metal latch 52 results in a connector latching retention force of about 25 pounds for each latch, or a total pull-apart resistance of about 50 pounds.

Figure 6:
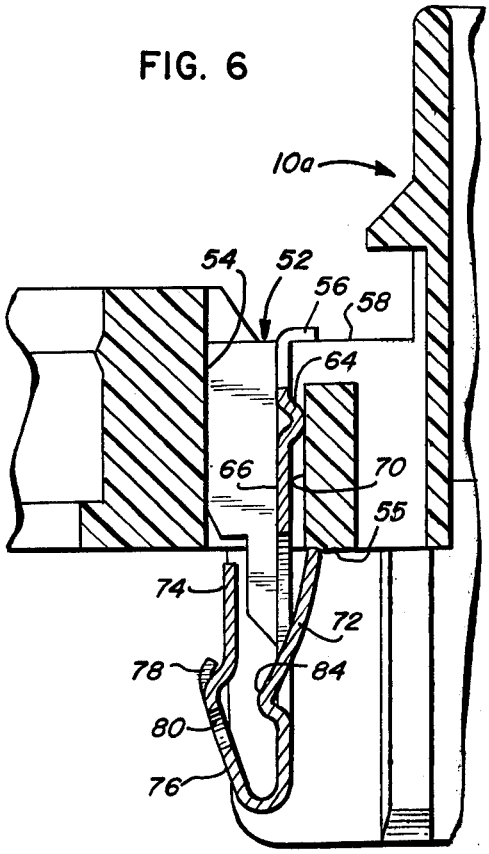
FIG. 6 is a fragmentary sectional view similar to FIG. 3 illustrating the metal latch of FIG. 4 disposed in a connector receptacle, a connector plug not being shown in FIG. 6.
Figure 7:
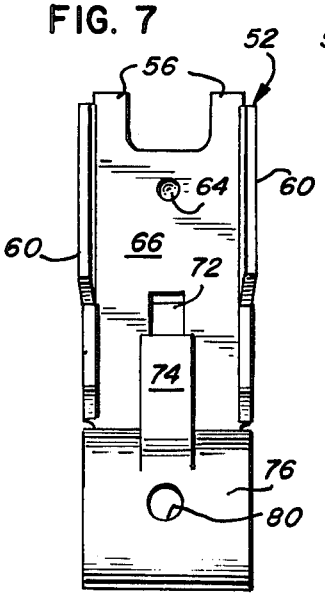
FIG. 7 is a front elevational view of the latch of FIG. 4.
Figure 8:
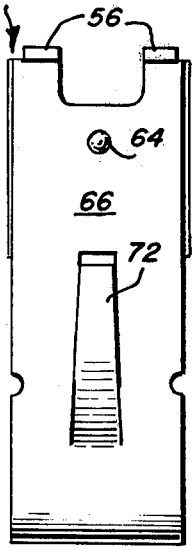
FIG. 8 is a rear elevational view of the latch of FIG. 4.

The latch 52 is assembled with connector 10*a* by inserting the same into the top of the opening 54 as illustrated in FIG. 6, and urging the latch downwardly until the right-angle stop feet 56 engsage upper planar surface 58 of the connector. Simultaneousy twin runner edge portions 60 (FIG. 4) of the clip slidably engage one wall of the connector opening 54, and dimple 64 formed in rear wall 66 of latch 52 slidably engages an opposed wall 70 of the cavity 54. Also slidably moving along cavity wall 70 is a spur 72 which is of such a size as to snap beneath the connector body, surface 55, see FIG. 6. Spur 72 will prevent unintentional removal of the latch 52 from its disposition within the connector cavity 54.

A tang 74 extends from an inclined latch face portion 76. The tang 74 is adapted to be engaged by the connector skirt portion 43 over edge 47 (see FIG. 1) as the illustrated connector-clip assembly of FIG. 6 is "rolled out" from a connector plug in the course of connector disengagement. This engagement of skirt portion 43 with the tang 74 forces the latch face 76 back away from the latch-receiving opening 44 of a plug connector 12, such as that illustrated in FIGS. 1 and 3. Tang 74 thus tends to eliminate the catching or hanging up of a latch member such as otherwise may occur in the normal course of effecting a connector assembly disengagement, e.g., with the integral J latch 32 of FIGS. 1 to 3.

Rounded nose portions 78 defining upper portions of the latch face 76 illustrated in FIGS. 4 and 6 prevent gouging of the skirt portion 42 of a connector plug member such as plug 12 illustrated in FIG. 1 in the course of separating the connectors. Also, it is apparent that the rounded nose portions 78 facilitate slidable engagement as the connector 52 is inserted in the aperture 54 as illustrated in FIG. 6.

Spur 72 is cut or punched from latch rear wall surface 66 with an upward taper (see FIG. 8) and then has a reverse bend 84 (FIG. 6) formed therein, thus assuring that the punched spur 72 will have adequate room to move through the resulting aperture in the rear wall 66 of the latch 52. If the spur 72 were merely punched from the rear wall, the same would not freely move relative to latch periphery from which punched because of the close tolerances and plating.

Figure 5:
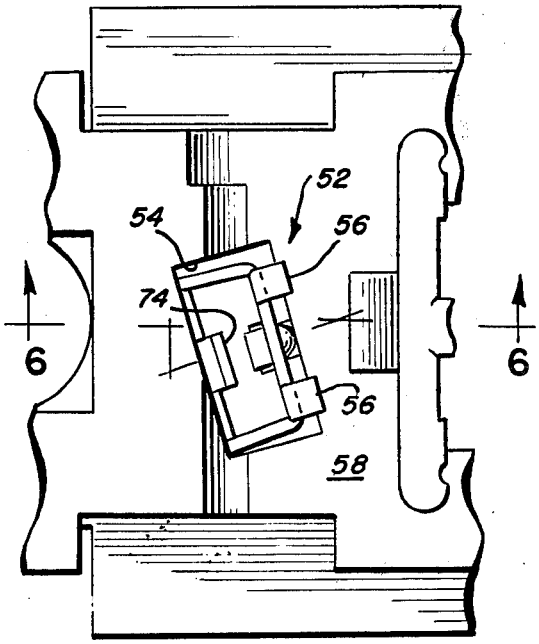
FIG. 5 is a top plan view illustrating the metal latch of FIG. 4 in assembled relationship with the connector receptacle body similar to that of FIG. 1.

The plan view of FIG. 5 illustrates a latch 52 in the inserted position with the stop portions 56 illustrated atop latch surface 58. In addition, FIG. 6 illustrates the snug engagement between the front and rear portions of the clip 52 in the connector cavity 54. Aperture 80 disposed in the latch face 76 facilitates engagement with a prod whereby the face may be resiliently urged toward rear surface 66 of the latch 52 for purposes of effecting an unlatching disengagement as the upper nose portion 78 of the latch are moved free from a skirt opening 44 of a connector plug member 12 most clearly seen in FIGS. 1 and 3. Simultaneously, the outer edge of the connector plug mated therewith is pressed away from the latch-mounting connector receptacle in the manner above described relative to the unmating of the connectors of FIGS. 1–3.

Figure 9:
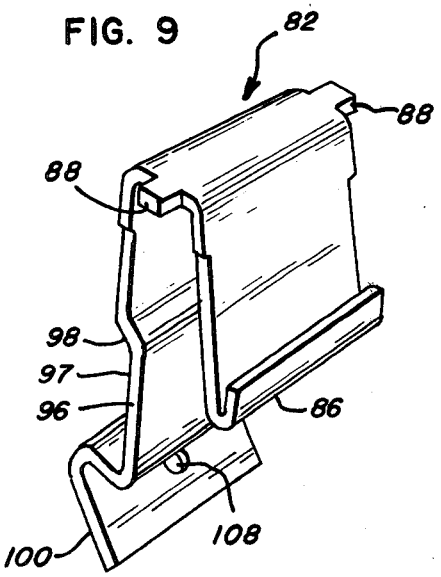
FIG. 9 is a perspective view of a second modified metal latch which may be employed in a connector receptacle opening in accordance with teachings of this invention.
Figure 11:
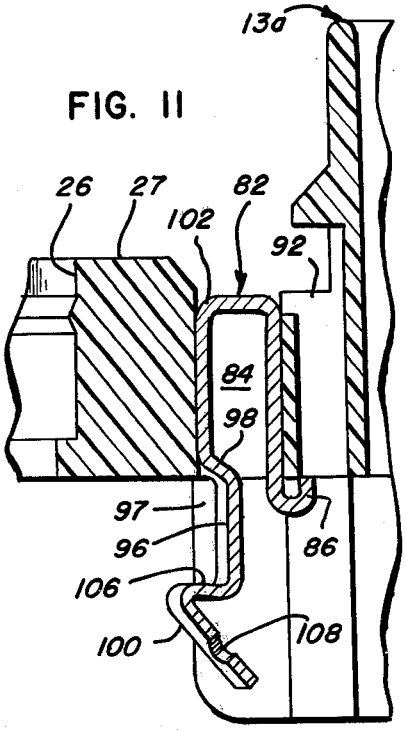
FIG. 11 is a sectional view taken on line 11—11 of FIG. 10.

Another embodiment of a metal insert latch comprises latch 82 illustrated in FIG. 9 of the drawing. Latch 82 is extremely strong, requires less expensive die work and piece part costs than the above-described latch elements, and as is apparent from the drawing is of a simple folded generally "J" shape. Latch 82 is inserted by movement downwardly in connector opening or latch-receiving pocket 84 of connector receptacle 13*a*, as illustrated in FIG. 11. Opening 84 is predeterminately molded into connector 13*a* to snugly receive metal latch 82. Stop fingers 88 limit downward movement of the latch 82 in aperture 84 by engaging recessed surface portions 90, most clearly seen in the plan view of FIG. 10. Portions 90 are at a lower level than surface 92 of the connector 13*a* seen in FIG. 11. As a result the latch 82 will be disposed beneath the level of connector surface 92. As fingers 88 engage the surface portions 90 of the connector, reverse bend 86 (FIGS. 9, 11) will snap into a locking engagement with the connector surface defining the bottom periphery of the latch-receiving aperture 84 as viewed in FIG. 11. Thus bend 86 insures retention of the latch 82 in its pocket 84 while the fingers 88 preclude withdrawal of the latch upon exertion of a pulling force on the latch tab 100 imparted by a skirt portion of a connector plug, such as plug 12, illustrated in FIGS. 1 and 3.

It should be noted that offset latch portion 96 defines in part a pocket 97 defined at its upper limits by angularly disposed portion 98. The offset portion 96 is defined at its lower limit as viewed in FIG. 11 by the upwardly and angularly disposed latch tab portion 100. The pocket 97 defined by latch portions 96, 98 and 100 receives aperture-defining portion 43 (see FIG. 3) of skirt 42 of a connector skirt 12 (see FIG. 1), and as a result the retention load is imparted to latch 82 in alignment with the pivot point 102 (FIG. 11) of the latch, thereby avoiding a bending moment tending to unlatch the clip when a parting load is imparted to two interlocked connectors.

The construction of FIG. 11 is to be compared with that of FIGS. 3 and 6 wherein the parting load is applied to a latch portion extending outwardly from the pivot points of the latch elements 32 and 52, respectively. A reverse taper at 106 (FIG. 11) whereat the latch tab 100 joins the latch vertical offset portion 96 assists in avoiding unlatching action under load by requiring a greater applied force in order to pivot such latch detent surface 106 downwardly under load.

The upwardly tapered latch tab 100 provides a lead-in slope facilitating insertion of the latch 82 in the connector receiving pocket 84. The tab 100 slides along one surface defining the connector pocket as the reverse bend 86 slides along an opposed connector surface. Aperture 108 disposed in the tab 100 provides a point of purchase for a disengagement tool such as a corner of a screwdriver, for pressing the tab inwardly together with the offset portion 96, thereby effecting disengagement with a connector skirt opening.

Figure 10:
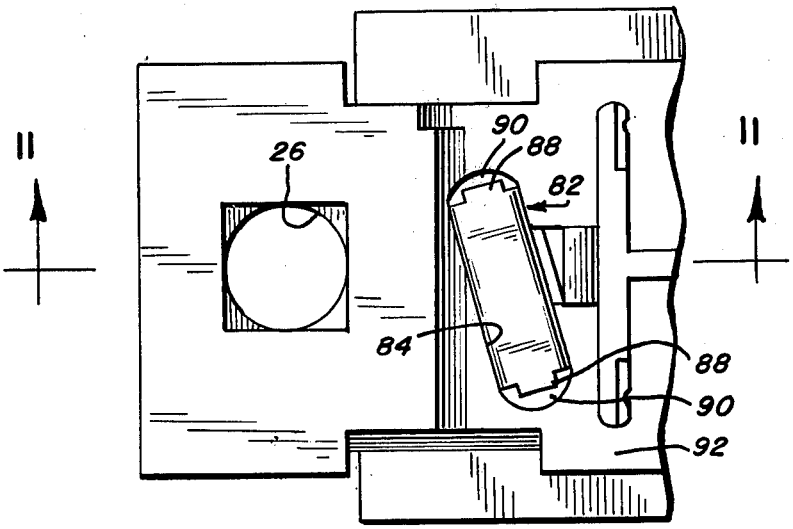
FIG. 10 is a figure similar to FIG. 5 of the drawing illustrating the metal latch of FIG. 9 in a normal disposition of use in a receptacle connector.

It will be seen from FIGS. 5 and 10 that the angular dispositions of the latch members 52 and 82 provide the desired polarization for proper interconnector engagement as previously described with respect to connector receptacle 10 illustrated in FIG. 1.

The engagement between the mating portions of the connector contacts, such as the mating portions 20 and 36, and the close engagement of other mating parts effect frictional resistance to the registration of two mated connectors. The resistance is increased by virtue of reverse bends in the contact mating portions. Such bends effect a terminal interlock, requiring additional force to effect separation as the mating portions 36 of the plug connectors are pulled free from between mating portions 20 of the connector receptacle. Moreover, it is apparent that the larger the number of contacts in the receptacle and plug connectors being disengaged, the greater the force which must be exerted for parting such connectors following an unlatching operation. Each of the foregoing designs provides for convenient separation of the mated connectors by prying them apart by the same tool or prod utilized to disengage one of the latches, as noted above.

The latch 82 of FIGS. 9 through 11 is preferably formed of annealed steel, is of desirably high strength, will support a parting load of approximately 30 pounds per clip, and although resistant to unintentional latching is readily unlatched by a simple pointed tool. In the course of separating a receptacle from a plug, the latch tab 100 clears the skirt portion of the connector 12 as skirt portion 43 (FIG. 1) bears against latch portion 96 during the rollout action, thereby preventing hang-up and facilitating a ready connector disengagement.

Figure 12:
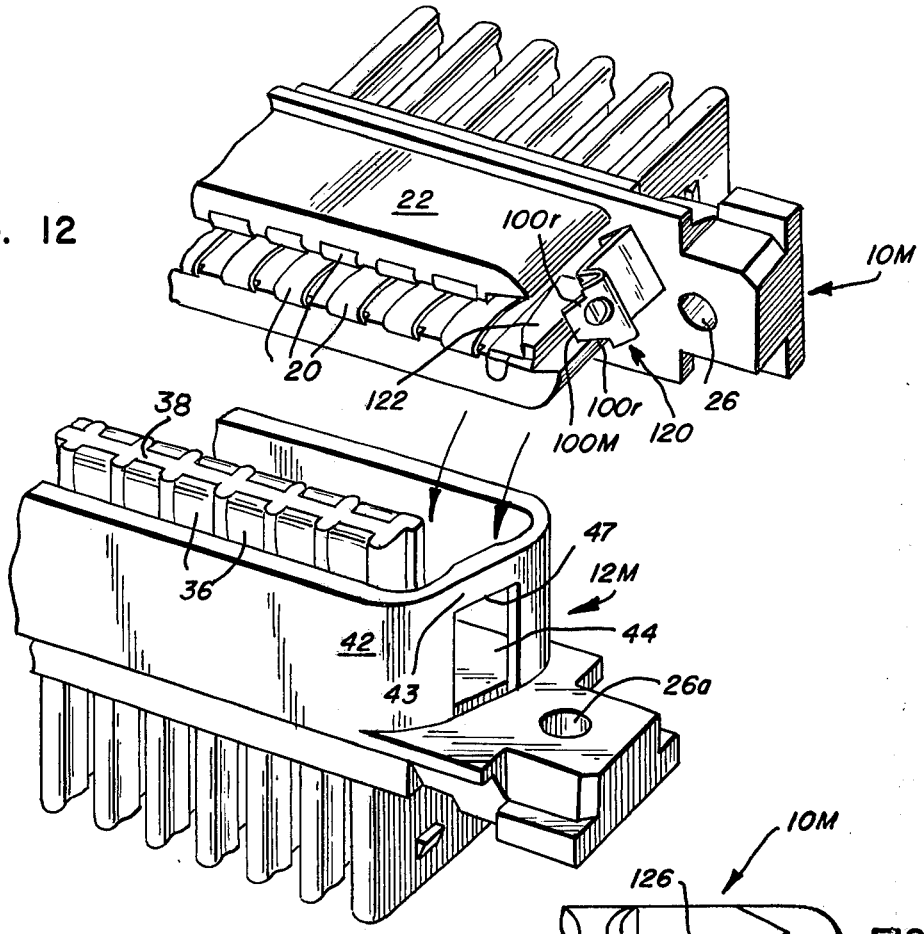
FIG. 12 is a fragmentary perspective view similar to FIG. 1 illustrating a modified metal latch employed with the illustrated connector receptacle and plug, said latch being similar to that illustrated to FIG. 9 of the drawing.

Referring now to FIG. 12, a modified connector receptacle 10*m* has mounted therein a metal latch 120 which is of precisely the same construction and configuration as latch 82 of FIG. 9 with the exception that opposed corner portions of tab 100*m* are relieved at 100*r*. As a result the tab 100*m* is substantially arrrow or wedge shaped.

Similarly, connector receptacle 10*m* is substantially the same as connector receptacle 13*a* of FIG. 11, with the exception that the body includes an additional portion defining an inwardly extending lead-in guide 122 formed integrally with one wall portion 22 adjacent a coring hole 123. Guide 122 narrows the effective gap G between beveled edges B of the terminal ends of the opposed walls 22 of connector 13 as illustrated most clearly in FIG. 13. As a result of the reduced gap a latch mounted in connector aperture 124 must have a tab narrower than tab 100 of latch 82 of FIG. 9 to be able to resiliently move inwardly without having one lateral tab portion strike the guide 122. Such inward movement is necessary in the normal latching and unlatching operations.

The modified latch construction 120 of FIG. 12 is adapted to be employed with the connector receptacle 12*m*. The tab 100*m* of latch 120 is adapted to inwardly flex in the normal course of use so as to clear connector body guide portion 122 illustrated in FIGS. 12 and 13.

Figure 13:
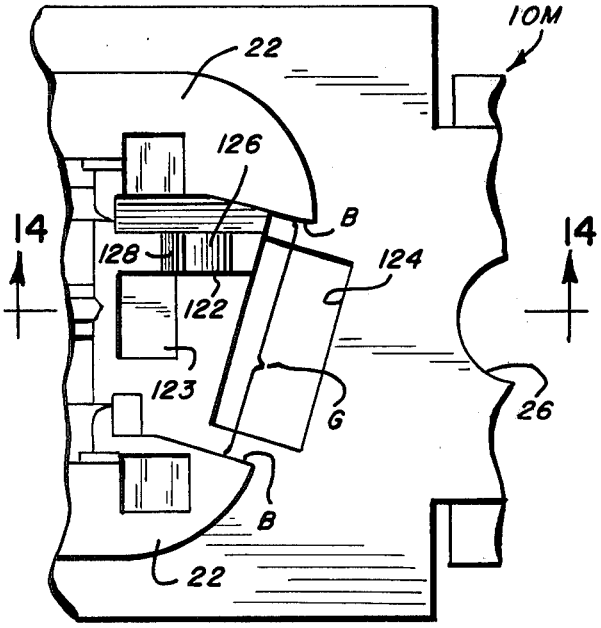
FIG. 13 is a fragmentary bottom plan view of the connector receptacle of FIG. 12 with the latching means thereof omitted.

It is the purpose of the connector body portion 122 to serve as a guide for the end of the central insulating support or rib 38 of connector plug 12*m* illustrated in FIG. 12. Because of the gap G between the opposed beveled edges B of connector supporting walls 22 of the connector receptacle 10*m* disposed on either side of the clip receiving aperture 124 as seen in FIG. 13, unless a lead-in guide 122 is employed to "guide in" or locate the end of rib 38 of the connector plug 12*m*, there would be a possibility of mismatching mating connector portions 20 of connector receptacle 10*m* with the connector mating portions 36 of the connector plug 12*m*. If the connectors were misaligned as little as 0.0454 of an inch (that is, if rib 38 were mispositioned along the recess between connector walls 22 by 0.045 inch), and a mating pressure were then applied to the opposed connectors for purposes of effecting an interlock, damage could easily follow. Such misalignment of the contact mating portions can result in the metal contacts being slightly twisted and deformed during attempted connector mating and disengagement of the misaligned connectors. The guide 122 avoids such problems by assuring that one end of the plug rib 38 is properly positioned longitudinally of the recess in the female connector as the connectors are joined to one another. Thus the mating contact portions of the two connectors are in desirably opposed alignment with one another prior to engagement of the contacts as the connectors are intermated.

Accordingly, by providing a lead in or guide such as lead-in 122 of FIG. 13, the connector plug rib 38 is appropriately guided into position between the opposed walls 22 of the connector receptacle 10*m*. With the plug rib thus properly positioned between receptacle walls 22, aligned engagement is assured between the desirably opposed mating contact portions 20 and 38 of the connectors 10*m* and 12*m* respectively.

Figure 14:
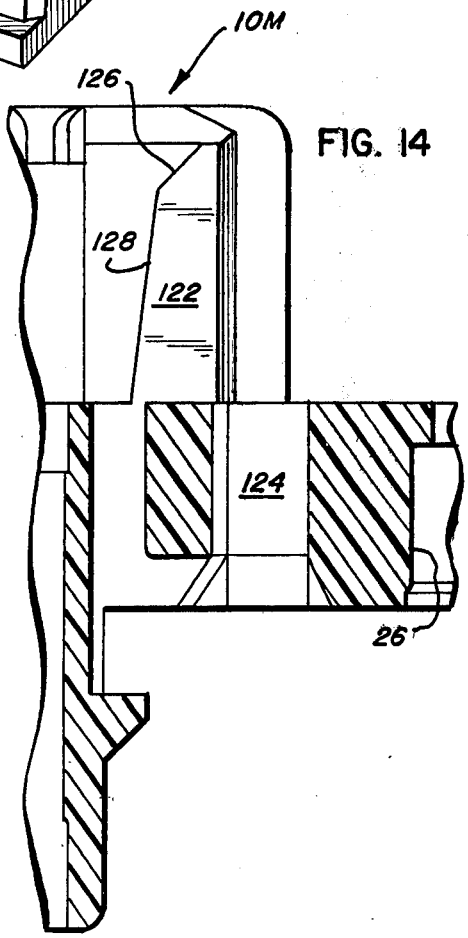
FIG. 14 is an enlarged sectional view taken on line 14–14 of FIG. 13.

It will be noted from FIG. 14 that the connector lead-in 122 has upper tapered surface 126 contiguous with lower tapered surface 128, said surfaces facing inward toward the center recess. In the normal course of effecting an interlock between connectors 10*m* and 12*m* of FIG. 12, an end of rib 38 of connector plug 12*m*, see FIG. 12, engages upper tapered surface 126 of the lead-in 122 of the connector receptacle 10*m* as seen in FIG. 14. It will be noted from FIG. 14 that the height of the lead-in in 122 is less than that of the connector side walls 22 but is of a sufficient height so that when the rib is urged into engagement with tapered surface 126, mating contact portions 20 and 38 of the mating connectors will be out of engagement until the rib 38 of the plug is desirably and properly received between the opposed wall portions 22 of the connector receptacle 10*m*.

It is thus seen from the foregoing, that FIG. 12 illustrates a modified latch 120 which is particularly designed to function with a connector receptacle having a built up guide portion 122. Guide portion 122 serves as a lead in for the rib portion of a mating connector plug without the danger of misalignment of mating contact portions in the connectors.

It is seen from FIGS. 13 and 15 that body portion 122 need only be present on one side wall 22 at each connector end. The peripheral configuration of both the connector skirt 42 of connector 12*m* and the wall portions 22 of the connector receptacle 10*m* effect a polarization necesssitating connector interengagement in which the mating contact portions are desirably aligned.

Disengagement between connectors 10*m* and 12*m* following an interlock is facilitated, and roll-out is assisted by modifying the skirt portion 42 of the connector 12*m* as illustrated in FIGS. 12 and 16–20. Such modification comprises the uniform relieving of the inner periphery of the skirt portion 42 of the connector 12*m* at the four corner portions disposed at the skirt ends. It is apparent from FIG. 16 that each end of the skirt 42 has a window 44 adapted to engage a detent portion of a latch element such as tab 100*m* of the latch 120 illustrated in FIG. 12. By relieving inner corner portions of the skirt 42 of the connector plug 12*m*, more clearance is provided for ease of roll-out in the course of the connector receptacle pivoting out of engagement with the connector plug 12*m*, simultaneously unlatching connector 120 from skirt window 44 as the latch tab 100*m* disengages from edge 47 of latch-receiving opening 44.

FIGS. 17 through 20 comprise sections taken through the relieved or beveled inner surface portions of the skirt 42. It will be noted from these latter four figures that the angle of the taper or bevel sloping outwardly and upwardly toward upper distal edge 130 of the skirt 42 is approximately 15° to the plane of the skirt inner surface.

It should be noted that tapers 132 disposed on the inner periphery of the corners of skirt portion 42 of the connector plugs 12*m* do not extend into connector portion 43 beneath which latch window 44 is disposed. If taper 132 extended all the way across the opposed ends of the skirt 42, the full thickness of the connector plug portion 43 in interlocking engagement with the latch 120 would not be available for "pushing off" of the latch away from the connector skirt window 44 during roll-out, resulting in a continuing interlock between the connector plug and receptacle. Accordingly the full thickness of the connector plug skirt portion 43 is necessary to facilitate roll-out although the corner portions disposed adjacent window 44 by being relieved facilitates connector disengagement.

FIG. 21 illustates a metal latch 134 adapted to be received in a preformed opening such as opening 136 of connector receptacle 138 illustrated in FIG. 23. Latch 134 has a lead in portion integrally formed therewith comprising a spring finger portion 140 which bears against an adjacent connector shoulder 142 in the manner clearly illustrated in FIGS. 22 and 23. As is more apparent from FIGS. 22 and 23, shoulder 142 is formed by relieving a side wall portion 22 of the connector receptacle.

As is seen from FIG. 21, finger 140 comprises approximately one-half the width of the latch 134, the remaining half comprising opposed wall portions 144 and 146 formed integrally with connecting bottom portion 148. Wall portion 146 terminates in a reverse bend portion 150 which functions as a retainer latch for securing the element 134 in a connector. Latch portion 144 is continuous with an of-set latch segment 152 joined to a terminal tab lead in portion 156. The latter portion is apertured at 158 for receipt of a suitable prod-type tool to facilitate unlatching of the tab portion 156 from a skirt opening of a connector plug, and separation of mated connectors as described above with respect to the other illustrated latches.

Referring to FIG. 24, it will be noted that bottom portion 148 of latch 134 has formed at opposed longitudinal ends thereof ears 160 which are received in a recess 162 of the connector 138. Latch 134 is inserted in connector opening 136 by pushing the finger 140 through the connector from the bottom of aperture 136 as illustrated in FIG. 23. The ears 160 function in conjunction with reverse bend portion 150 of the latch to securely position the anchoring portion of latch 134 in the connector opening 136 in a manner similar to the other embodiments of insert clips described above. It will be noted from FIGS. 21 through 23 that the spring finger portion 140 of latch 134 has lower opposed wall portions 146*a* and 144*a* disposed within the connector aperture 136. Extending from wall portion 146*a* is upwardly and angularly disposed finger portion 166 which is contiguous with an inclined surface portion 168 at edge 169, which is in turn contiguous with a terminal lip 170.

In the normal position of latch-connector assembly illustrated in FIG. 22, spring finger 140 and particularly edge 169 abuts against stop shoulder 142 of the connector. It will be noted from FIGS. 21 and 22 that the latch tab portion 156 adapted to engage a complementary opening in a connector plug skirt, is cut away at 156*r* so as to permit inward pivotal movement toward the spring finger 140 without engaging the same.

It will be further noted from FIG. 22 that the spring finger 140 engages the stop shoulder 142 at an outer edge portion only, whereby the remainder of the spring finger laterally disposed of the edge portion engaging the stop shoulder is available for engaging the rib of a connector plug. Finger 140 will serve to properly position the connector rib longitudinally of the recess defined by the opposed side wall portions 22 of the female connector, similarly to the manner in which plastic end wall portion 122 of connector 10*m* functions for rib positioning purposes as above described. Thus, in the normal course of use the latch spring finger 140 will properly locate the end of a rib of a connector plug so as to properly align mating portions of contacts whereby a connector plug and receptacle may have their contacts interconnected with a minimum of difficulty.

It is also noted from FIG. 23 that the height of each spring finger 140 is less than the height of the connector wall portions 22 but is sufficiently high to prevent any contact between mating contact portions of a connector plug and receptacle in the course of intermating prior to rib alignment. The sloping surface portions 170 and 168 of each latch 134 facilitate alignment of one connector relative to the other as they are being mated. It will be noted from FIG. 21 that the rib-positioning finger portion 140 of the latch 146 and the adjacent anchoring portion which is integral with the latching tab 156, are separated along their entire height.

In the course of separating an interlocked connector plug and receptacle, the finger portion 140 of the unlatched latch 134 readily is flexed outwardly by the rib of the connector plug in the course of roll-out thereby facilitating disengagement between the two connector members. The latch 134 of FIG. 21, therefore, provides correct alignment between connectors when mating, full latch engagement for maximum strength when mated, and insures ready latch disengagement upon roll-out.

In addition to being automatically joinable to one another by the aforedescribed snap locking of the latches in the respective receiving openings, each of the above described connectors is adapted for joining to existing connectors which require separate securing devices such as screws or bolts. This is accomplished by maintaining the end portions free of overlying structure and by providing the securement openings 26 and 26*a* therethrough.

Whereas the latch constructions described above are adapted for effecting an interconnector assembly, my aforesaid copending application Ser. No. 736,895 discloses clips which may be readily secured to or are engageable with the connector ends as at 24 and 25 for purposes of securing the connectors to panels such as chassis members. That application also describes hoods which interlock with such connector ends.

It is believed apparent from the foregoing description that significant improvements in ribbon-type electrical connectors have been disclosed. The disclosed connectors may be of a variety of sizes, and all of the connectors are formed entirely of plastic with the exception of the metal contacts and latches mounted therein. In each embodiment a pair of connectors are joined and interlocked by the single step of pressing the noted connectors together. No additional fasteners need by applied. Yet the connectors are compatible for securement with other connectors in a conventional manner. In each instance, the entire body may be formed as a unitary molding, without side coring. In the first-discussed embodiment the latching means also are included as an integral part of a connector receptacle molding. The metal latch embodiments are adapted for convenient assembly with the molded connectors. The metal latches provide great holding strength, yet facilitate parting disengagement between interlocked receptacle and plug connectors.

It is believed apparent from the foregoing that a variety of constructions have been provided which, although simple in structural detail, are efficient in use. It is also believed apparent that a large number of modifications may be made in the structures above disclosed, and this invention is to be limited therefore only by the scope of the appended claims.

What is claimed is:

1. In a ribbon connector construction the combination comprising a body of electrically insulating plastic; a plurality of wire engaging contacts mounted thereon; each of said contacts having a wire termination portion for engaging a wire in electrical contact and a mating portion for engaging a contact mating portion of another connector in electrical contact; resilient latch means of substantially J-shaped configuration having a proximal longer arm anchored to said connector body and extending therefrom in a direction generally parallel to said mating portion of said contacts; said latch means having a shorter distal arm defining a detent and integrally formed with said proximal arm; said latch means detent being arranged on an outwardly disposed face of said distal arm and facing generally toward said connector body; said longer arm and shorter arm being resiliently movable relative to said connector body for resilient snap engagement with an element to which said connector is to be attached.

2. The construction of claim 1 in which said shorter arm has an outer face with a recess therein for facilitating engagement with a prod tool and a projecting detent disposed on said outer face.

3. The construction of claim 1 in which said latch means is integral with said connector body.

4. The construction of claim 1 in which said latch means is a J-shaped element mounted on said body.

5. The construction of claim 1 wherein said longer arm and shorter arm are resiliently movable inwardly relative to said connector body along substantially the entire length of said latch means longer arm, and including stop surface means integrally formed with said connector body adapted to engage rear surface portions of said latch means longer arm upon inward flexing of said latching means longer arm, said stop surface means being spaced adjacent the rear surface of said latching means longer arm.

6. The construction of claim 5 in which said shorter arm has a depressed area on its outer face for facilitating engagement with a prod tool and a projecting transverse, projecting detent disposed on said outer face.

7. In a ribbon connector construction the combination comprising a body of electrically insulating plastic; a plurality of wire engaging contacts mounted thereon; each of said contacts having a wire termination portion for engaging a wire in electrical contact and a mating portion for engaging a contact mating portion of another connector in electrical contact; resilient latch means having a proximal end portion integrally formed with said connector and a distal portion contiguous with but separate from said proximal portion and projecting from said connector body in a direction generally parallel to said mating portions of said contacts; and latch proximal portion and distal portion defining a substantially J-shape, said distal portion having an outwardly projecting detent portion; said latch means being resiliently inwardly movable relative to said connector body along substantially its entire length, and stop surface means integrally formed with said connector body adjacent said latch means proximal portion and adapted to engage rear surface portions of said latching means proximal portion upon inward flexing thereof whereby the distance said latch means may move inwardly of said connector is limited.

8. The construction of claim 7 in which said latch means has a depressed area on its outer face for facilitating engagement with a prod tool and a projecting transverse, projecting detent disposed on said outer face.

9. The ribbon connector construction of claim 7 in which said latch means is of substantially J-shaped configuration having a longer proximal arm integrally joined with said connector at one end portion, and a shorter distal arm integrally formed with said longer arm; said latch means being resiliently movable inwardly about the integral point with the connector.

10. The connector construction of claim 9 in which said latch means distal arm has a projecting detent disposed on its outer face.

11. In a ribbon connector construction the combination comprising a body of electrically insulating plastic; a plurality of wire engaging contacts mounted thereon; each of said contacts having a wire termination portion for engaging a wire in electrical contact and a mating portion for engaging a contact mating portion of another connector in electrical contact; discrete resilient latch means detachably anchored on spaced portions of said connector body; each of said latch means having a projecting detent portion adapted to engage in interlocking relation a mating latch means disposed in a body portion of said another connector; said connector body having spaced openings for receiving said resilient latch means, each of said means including a limit stop at one end to limit movement of said means into the respective opening and a resilient latch means portion movable through such opening and engageable with a portion of said body adapted to preclude removal of said latch means from said body.

12. The construction of claim 11 wherein said projecting detent portion has a face portion facing generally outwardly of said connector body, and being connected to a latch means rear wall portion, the latter portion extending from such anchoring engagement with said connector; the removal precluding portion of said latch means including a resilient reverse bend stop portion integrally formed from said rear wall portion adapted to engage at its distal end a peripheral portion of said connector defining said opening in the normal position of latch means assembly with said connector thereby to prevent removal of said latch means from said connector opening; said reverse bend portion being resiliently movable toward said detent portion for insertion of said latch means into one of said connector openings.

13. The construction of claim 12 in which projecting ears are integrally formed with portions of said latch means rear wall portion spaced from said detent portion for preventing passage of said latch means through said connector opening; the interval between said projecting ears and the distal end of said reverse bend portion substantially defining the depth of said connector opening.

14. The construction of claim 13 in which said latch means has opposed side walls formed integrally with a rear wall portion thereof; said side walls being of such dimensions as to be snugly received in said connector opening; the engagement between said latch means and connector opening being such that said latch means is not movable in said opening other than axially along the opening central axis; axial movement of said latch means being prevented when said latch means is disposed in said connector opening and said latch means ears and reverse bend portions are in a normal position of assembly with said connector.

15. The construction of claim 12 in which said latch means projecting detent portion is bendable toward the connector opening central axis about a pivot axis and is contiguous with a latch means offset portion which connects said detent portion with said pivot axis, whereby parting force applied to said detent in the normal course of latch means use is imparted to said latch means in line with said pivot axis.

16. The construction of claim 12 in which said latch means projecting detent portion has a tang formed therewith disposed between said detent outer face and said reverse bend portion and extending substantially parallel to the central axis of said connector opening in which said latch means is disposed.

17. The construction of claim 12 in which said latch means reverse bend portion is formed on a taper from a latch means wall portion oppositely disposed to said projecting detent portion, and is bent upon itself along the length thereof whereby it may freely move relative to the peripheral wall portion from which cut about a bending axis comprising its juncture with said wall portion.

18. In a ribbon connector receptacle construction having opposed mating contact portions supported on spaced parallel walls, the combination comprising a body of electrically insulating plastic; a plurality of wire-engaging contacts fixedly mounted on said body; resilient latch means extending from spaced portions of the connector body and having distal portions adapted to effect an interlock with a latch-receiving opening of a mating connector; and guide means formed in said plastic body adjacent said latch means for guiding a mating connector into desired interlocked relation with said connector latch means.

19. The ribbon connector of claim 18 in which said guide means comprises a downwardly and inwardly sloping surface laterally projecting from the end of one of said connector receptacle walls.

20. The ribbon connector of claim 19 in which the height of said guide means is less than that of said receptacle walls whereby the distal end thereof is located beneath the distal edges of said walls.

21. In a ribbon connector construction, the combination comprising a body of electrically insulating plastic; a plurality of wire-engaging contacts mounted on said body; resilient clip means mounted in spaced portions of said connector body; each of said clip means having a first resilient latch portion for engaging a latch-engaging element of a second connector adapted to interlock with said ribbon connector; each of said clip means having a second resilient portion; a shoulder predeterminately formed in said ribbon connector body engaging said clip means second resilient portion; said second resilient portion being adapted to guide such second connector into properly aligned engagement with said ribbon connector prior to interlocking therewith.

22. In a connector assembly the combination comprising a connector receptacle having a body of electrically insulating plastic with a plurality of wire-engaging contacts mounted thereon; said connector body having parallel projecting walls extending longitudinally of said connector; mating portions of said wire-engaging contacts being arranged on opposed inner surfaces of said walls; latch means adapted to engage another connector, interposed said connector walls at opposed longitudinal ends thereof; a connector plug having a body of electrically insulating plastic with a plurality of wire engaging contacts mounted thereon; a projecting rib extending longitudinally of said plug body having mating portions of said contacts aligned on opposed surfaces thereof; a connector skirt portion encompassing said rib; said skirt portion having openings for receiving portions of said connector receptacle latch means disposed at opposed ends of said skirt portion; guide means disposed in an end portion of said connector receptacle body between said walls adapted to engage and guide one end of said connector rib into proper disposition between said connector-receptacle walls whereby the contacting mating portions of said connector plug are aligned opposite said mating portions of said connector receptacle and said contact portions may engage in proper relation when said connectors are intermated.

23. The assembly of claim 22 in which said guide means of said connector receptacle comprises an inwardly projecting portion of one of said parallel walls disposed at one wall end; said projecting portion having a downwardly and inwardly sloping surface for guiding one end of a connector plug rib downwardly between the opposed walls of said connector receptacle.

24. The assembly of claim 22 in which said guide means comprises a resilient clip portion integrally formed with a latch means portion interposed end portions of said parallel walls.

25. The assembly of claim 24 in which said resilient clip portion extends across substantially the entire interval between said parallel walls at one end thereof and is resiliently movable from a fixed positioning surface formed in one of said walls outwardly toward said latch means.

26. In a ribbon connector construction, the combination comprising a body of electrically insulating plastic, a plurality of wire-engaging contacts mounted thereon; said connector body having a projecting support extending longitudinally of said connector on which portions of said contacts are mounted, and a skirt portion encompassing said support; said skirt portion having a generally rectilinear peripheral configuration, each corner portion of said skirt being relieved on its interior surface with a tapered bevel extending toward the distal edge thereof; the thickness of said skirt portion intermediate said corner portions being of a greater thickness than said relieved corner portions.

27. The connector construction of claim 26 wherein said skirt is relieved in a manner to form a bevel directed toward the skirt distal edge effecting an angle of approximately 15° to the plane of the skirt wall.

28. The connector construction of claim 26 in which a latch receiving opening is disposed at opposed longitudinal ends of said skirt portion between said skirt relieved corner portions.

29. The connector construction of claim 26 wherein each of said contacts has a wire termination portion for engaging a wire in electrical contact and a mating portion adapted to engage a contact mating portion of another connector; said contact mating portions being supported on said projecting support and said skirt portion being of general trapezoidal configuration.

30. In a connector receptacle construction the combination comprising a body of electrically insulating plastic having a plurality of wire-engaging contacts mounted thereon; said connector body having parallel projecting walls extending longitudinally of said connector; portions of said wire-engaging contacts being arranged on opposed inner surfaces of said walls; latch means for engaging latch engaging portions of a connector plug mounted in said receptacle interposed said connector walls at opposed longitudinal ends thereof; opposed inner end portions of said walls adjacent said latch means being formed to guide an end of such mating connector plug downwardly between said walls whereby the contacts of said receptacle connector and such connector plug are desirably aligned prior to intermating of said connectors; said latch means being disposed outwardly of the inner end guide portion disposed adjacent thereto, exteriorly of said connector wall surfaces.

31. In a connector receptacle construction the combination comprising a body of electrically insulating plastic having a plurality of wire-engaging contacts mounted thereon; said connector body having parallel projecting walls extending longitudinally of said connector; portions of said wire-engaging contacts being arranged on opposed inner surfaces of said walls; latch means adapted to engage another connector interposed said connector walls at opposed longitudinal ends thereof; an inwardly projecting connector portion formed on at least one end portion of at least one of said walls; said inwardly projecting portion being disposed inwardly of one of said latch means disposed in adjacent relation therewith; said projecting portion having a guide surface formed on a distal end portion thereof sloping downwardly and inwardly of said connector.

32. A latch construction for a ribbon-type connector comprising a planar rear wall portion; a latching tab portion integrally formed with said rear wall portion so as to define a substantial J-shape; said rear wall portion also being integrally formed with parallel side wall portions arranged at right angles to said rear wall portion; each of said side wall portions being of uniform width for a substantial portion of its length; a tang integrally formed with said tab portion offset inwardly toward said rear wall portion and extending away from said tab portion and parallel to said latch rear wall portion for a major portion of its length; movement of said tang toward said rear wall portion causing said tab portion to move toward said rear wall portion.

33. The latch construction of claim 32 in which a reverse bend portion is cut from said latch rear wall portion and bent upon itself so as to be freely movable relative to the rear wall portion from which cut; opposed edge portions of said latch rear wall terminating in projecting feet extending at substantially right angles to said latch rear wall; the terminal end of said latch reverse bend portion extending toward said projecting foot portions.

34. A latch construction for use with a ribbon connector comprising a detent portion of substantially J-shaped configuration integrally formed with a base portion; said base portion being also integrally formed with a resilient finger extending from said base portion in opposed relation with said detent portion, said detent and finger portions being integrally formed with laterally disposed base portions adapted to anchor said latch construction in an aperture of a ribbon connector or the like.

35. The latch construction of claim 34 in which a reverse bend portion is integrally formed with a terminal end of the latch base anchor portions, and said latch base portion is integrally formed with laterally disposed projecting ears; said reverse bend portion being resiliently inwardly movable toward the central longitudinal axis of said latch construction.

36. The latch construction of claim 34 in which retention means for preventing removal of said latch construction from a latch aperture is connected to said finger and resiliently movable therewith.

37. In a latch construction for a ribbon connector, a detent portion of substantially J-shaped configuration integrally formed with an offset wall portion connecting said detent portion to a pivotal juncture with a latch base portion whereby force applied to said detent portion in the normal course of latch use being in substantial alignment with such pivot point; said latch detent and offset portions being joined by means of said base portion to an opposed latch wall portion terminating in a reverse bend portion, said latch detent portion and opposed wall portion being in nonparallel relationship so as to generally converge where joined with said latch base portion.

* * * * *

UNITED STATES PATENT AND TRADEMARK OFFICE

CERTIFICATE OF CORRECTION

PATENT NO. : 4,113,179

DATED : September 12, 1978

INVENTOR(S) : WILLIAM H. McKEE

It is certified that error appears in the above-identified patent and that said Letters Patent are hereby corrected as shown below:

Column 6, line 24, change "engsage" to -- engage --

Column 8, line 41, change "arrrow" to -- arrow --

Column 9, line 7, change "0.0454" to -- .045 -- line 9, change "0.045" to -- .045 --

Column 10, line 52, change "of-set" to -- off-set --

Column 15, line 41, change "contacting" to -- contact --

Signed and Sealed this

*Third* Day of *April 1979*

[SEAL]

*Attest:*

RUTH C. MASON
*Attesting Officer*

DONALD W. BANNER
*Commissioner of Patents and Trademarks*